US006100227A

United States Patent [19]

Burlew

[11] Patent Number: 6,100,227

[45] Date of Patent: Aug. 8, 2000

[54] INDUSTRIAL CLEANER DISPERSANT FORMULATION

[75] Inventor: James O. Burlew, Topeka, Kans.

[73] Assignee: Joan Docter, Dayton, Ohio

[21] Appl. No.: 09/293,650

[22] Filed: Apr. 17, 1999

[51] Int. Cl.[7] ..... C11D 17/00; C11P 9/00

[52] U.S. Cl. ..... 510/245; 365/421; 365/424; 365/499; 365/500; 365/506

[58] Field of Search ..... 510/245, 365, 510/421, 424, 499, 500, 506

*Primary Examiner*—Necholus Ogden

*Attorney, Agent, or Firm*—R. William Graham

[57] ABSTRACT

An ultra heavy duty industrial cleaner, degreaser, dispersant and emulsifier formulation is described. The formulation comprises at least one propylene glycol alkyl ether, at least one 1-alkyl-2-pyrrolidinone, at least one polyoxyethylene aliphatic ether, at least one polyoxyethylene aliphatic ether, at least one trialkanolanine, d-limonine, at least one alkylaryl sulfouate, and at least one aliphatic alkanol.

4 Claims, No Drawings

INDUSTRIAL CLEANER DISPERSANT FORMULATION

BACKGROUND OF THE INVENTION

The present invention relates to a chemical formulation useful as a cleaner, degreaser, emulsifier and dispersant in industrial operations. The present formulation is particularly useful in industrial operations involved in removing oil spills at sea and for cleaning oil contaminated shorelines.

Major oil spills in both fresh and salt water continue to be of a major concern. Such oils spills damage marine life, contaminate water, pollute the shorelines and threaten the extinction of water foul and other wild life that depend upon an unpolluted environment.

Existing methods of controlling oil spills include fences, booms and skimmers to physically contain or remove oil on the water surface, coagulants which chemically interact with the oil, and absorbents such as straw which absorb the oil, have all shown some measures of success. However, more effective formulations and methods are needed to preserve our environment from the effects of oil spills.

SUMMARY OF THE INVENTION

It is an object of the invention to provide a formulation useful for removing grease and oil deposite from metal surfaces.

It is another object of the invention to provide a formulation useful for dispersing and removing crude oil spills at sea and for cleaning oil-contaminated shorelines.

In accordance with the present invention, a combination of certain surface active agents, detergents, hydrotropes, soaps and quaternary surfactants have been found to be effective in industrial cleaning and degreasing operations such as the removal of various oils, e.g.,quenching oils, drawing oils, rolling oils, cutting fluids, etc. from a variety of heat treated fasteners, stamping and the like. The present formulation in particularly useful as a dual application formulation for dispersing crude oil spills at sea and for cleaning shorelines.

The formulation of the present invention contains a surface active agent, detergent, hydro-trope, soap, and quaternary cationic surfactant. More typically, the formulation comprises:

at least one propylene glycol alkyl ether;

at least one 1-alkyl-2-pyrrolidinone;

at least one polyoxyethylene aliphatic ether at least one polyoxyethylene alkoxylate;

at least one trialkanolamine;

d-limonene;

at least one amine alkylaryl sulfonate; and at least one aliphatic alcohol.

DETAILED DESCRIPTION OF THE INVENTION

The formulation of the present invention contains selected aliphatic compounds which provide maximum concentrations, efficiencies and compatibilities to provide exceptional cleaning properties with total dispersion and emulsification.

The formulation is biodegradable, neutral, stable, aids in rust inhibition of ferrous metals as well as inhibits corrosion of non-ferrous metals such as aluminum, copper, zinc, etc., and is designed to provide maximum surface action to remove oil, grease, and soil into dispersions, suspension and emulsions with water. It readily disperses oil into fine particles that permit more rapid bio-degradation into the environment by the action of air, sunlight, and micro-organisms.

The formulation of the invention is prepared from a balanced blend of anionic and non-ionic surface active hydrotropes that provides exceptional cleaning properties, corrosion inhibiting properties to metal surface and is particularly dispersible in both water and oil with intermediate solvency therein. In general the formulation comprises:

at least one propylene glycol alkyl ether;

at least one 1-alkyl-2-pyrrolidinone;

at least one polyoxyethylene aliphatic ether;

at least one polyoxyethylene alkoxylate;

d-limonene;

at least one amine alkylaryl sulfonate; and at least one aliphatic alcohol.

Representative examples of the propylene glycol alkyl ether of the formulation include propylene glycol methyl ether, propylene glycol ethyl ether, propylene glycol propyl ether, propylene glycol isopropyl ether, propylene glycol isobutyl ether, propylene glycol butyl ether and the like and mixture thereof. Propylene glycol ethyl and propyl ethers are slightly more toxic than propylene glycol butyl ether and, therefore, are not recommended for most applications. Glycol PB, a propylene glycol butyl ether available from Ashland Chemical has been found to be particularly effective in the present invention.

The 1-alkyl-2-pyrrolidinone useful as an ingredient in the formulation is represented by 1-methyl-2-pyrrolidinone, 1-ethyl-2-pyrrolidinone, 1-propyl-2-pyrrolidinone, 1-isopropyl-2-pyrrolidinone, 1-butyl-2-pyrrolidinone, and the like, and mixture thereof. (Surfadone)-1,-methyl-2-pyrrolidinone, available from Ashland Chemical has been found to be an effectve surfactant in the present invention.

The combination of propylene glycol alkyl ether and the 1-methyl-2-pyrrolidinone greatly enhances the effective solvent and hydrotrope action of the polyoxyethylene alkoxylate anonic sufactant used in the formulation.

The polyoxyethylene aliphatic ether useful as a non-ionic surfactant component of the invention includes polyoxyethylene dodecyl ether, polyoxyethylene tridedecyl ether, polyoxyethylene stearyl ether, polyoxyethylene myristyl ether, polyoxyethylene palmityl ether, polyoxyethylene undecyl ether, polyoxyethylene decyl ether, polyoxyethylene oleyl ether, and the like. Typically, the polyoxyalkylene aliphatic ether is a mixture of at least two polyethylene aliphatic ethers. In a preferred aspect of the invention, the polyoxyalkylene aliphatic ether is a mixture of polyoxyethylene oleyl ether and polyoxyethylene undecyl ether wherein the ratio of polyoxyethylene oleyl ether to polyoxyethylene undecyl ether is about 1:10 to 10:1 and preferably about 1:5. A mixture of Rhodasurf ON-870, a polyoxyethylene oleyl ether available from Rhonc-Poulenc and Genapol UD-075, a polyoxyethylene undecyl ether available from Celanese Corp. has been found to be effective as the polyoxyethylene aliphatic ether component in the present invention.

The polyoxyethylene alkoxylate useful as a component of the formulation composition of the invention includes polyethylene alkoxylates wherein the alkoxy radical contains about 3 to 18 carbon atoms. Representative examples of useful polyethylene alkoxylates includes polyoxyethylene alkyl oxylate, polyoxyethylene alkylaryl oxylate, Rhodafac PC-100 or PL-620, a linear alcohol ethoxylate available from Rhone-Poulenc has been found to be effective in the present invention. Polyoxyethylene alkyl phosphonate, a linear alcohol alkoxylate available from Witco under the name Witco 51-3075 may, is some instances be substituted for the polyoxyethylene alkoxylate in the present formulation.

The trialkanolamine a component of the formulation is preferably a lower trialkanolamine such as triethanolamine, available from Ashland chemical.

d-Limonene which is structually related to isoprene is employed as a solvent or surface agent in the present formulation.

The amine alkylaryl sulfonate useful as a component of the present formulation includes Witco PC-205 amine alkylaryl sulfonate, Witconate P10-59 amine alkylaryl sulfonate and Witconate 93 S, an amine sulfonate also available from Witco has been found to be effective in the present invention.

The aliphatic alcohol useful as an additional component of the inventive formulations is a linear or brauched $C_5$–$C_{10}$ aliphatic alcohol. Representative examples of such alcohols include pentanol-1,2methyl-1-pentanol, 2- ethyl-1-pentanol, 2-methyl-1-hexanol, 2-ethyl-1-hexanol, 1-methyl-1-heptanol, 2-ethyl-1-heptanol, 3-methyl-1-pentanol, 3-ethyl-1-hexanol, 3-methyl-1-pentanol, 3-ethyl-1-pentanol, and the like, Mixtures of such alcohols are also contemplated. Rhodafac PEH, 2-ethyl-1-hexanol available from Rhono-Poulenc has been effective as the aliphatic alcohol in the present invention. Polypropylene glycol ethoxylate may, in some instance, be subitituted for the aliphatic alcohol, or may be used in combination with the aliphatic alcohol.

The concentration of the specific components of the present formulation are those concentrations ranges which provide the desired characteristics of the formulation. For example, the formulation of the invention will typically contain about 5 to 15% propylene glycol alkyl ether, about 2 to 8% 1-alkyl-2- pyrrolidinone, about 25 to 35% polyoxyethylene aliphatic ether, about 15 to 25% polyoxyethylene alkoxylate, about 1 to 5% trialkanolamine, about 1 to 5% d-limonene, about 20 to 30% amine alkylaryl sulfonate, and about 2 to 8%, alpihatic alkanol. All percentages are by volume unless otherwise specified.

Other additives may be added to the formulation to provide their desired effects. For example, Forert Green (Pylaklor S-547) available from Pylam Products Company may be added to the formulation for color coding purposes.

The essential and prominant chemical and physical properties of the formulations are as follows:

dispersible in water and hydrocarbons;

environmentally degradable;

exhibits balance in anionic and non-ionic surface active agents;

exhibits enhanced intermediate solvent-active hydrotropes;

exhibits agreeable citrus odor;

is non-hydroscopic;

is free of volatiles having a boiling point less than 100° C.;

is free of aromatics, electrolytes, heavy metals and chlorohydrocarbons;

exhibits a neutral to slightly alkaline pH;

inhibits corrosion of metal surfaces;

is non-reactive has indefinite storage capabilities;

in stable over a wide temperature range;

exhibits a liquid physical state over a wide temperature range;

is non-irritant;

is non-rancid;

is free from known and suspect carcenogens, mutagens and teratogens;

is non-hazardous (DOT classification);

exhibits very low biological toxicities;

is safe for use in steam cleaning;

is stable to alkaline additives; and is packagable in plastic or metal containers;

EXAMPLE

Into a 400 gallon tank, the following ingredients are blended with continuous stirring until throughly mixed: 100 liters of propylene glycol butyl ether, 50 liters of 1-methyl 2-pyrrolidinone, 50 liters of polyoxyethylene (20) oleyl ether (heated to 95° F. to become pourable), 250 liters of polyoxyethylene (20) undecyl ether, 200 liters of polyoxyethylene alkyoxylate, 25 liters of triethanolamine, 25 liters of d-limonene, 250 liters of amine alkylaryl sulfonate, and 50 liters of 2-ethyl-1-hexanol.

A portion of the formulation in aqueous solution or in hydrocarbon solvent is sprayed onto a grease-containing metal surface. The grease is quickly dissolved and easily removed. Another portion of the formulation is sprayed onto a simulated crude oil slick. The crude oil is rapidly dispersed and eliminated.

It will be recognized by those skilled in the art that changes may be made to the above described formulation without departing from the broad concept thereof. It is understood therefore, that this invention is not limited to the particular embodiments disclosed but is intended to cover all modifications, which are within the scope of the invention or defined by the appended claims.

What is claimed is:

1. A formulation for cleaning and degreasing metal surfaces comprising:

about 10% propylene glycol butyl ether;

about 5% 1-methyl-2-pyrrolidinone;

about 5% polyoxyethylene (20) oleyl ether;

about 25% polyoxyethylene (20) undecyl ether;

about 20% of a different polyoxyethylene alkoxylate;

about 2.5% triethanolamine;

about 2.5% d-limonene;

about 25% amine alkylaryl sulfonate; and about 5% 2-ethyl-1-hexanol.

2. A formulation for dispersing and aiding in removal of crude oil spills, comprising:

about 10% propylene glycol butyl ether;

about 5% 1-methyl-2-pyrrolidinone;

about 5% polyoxyethylene (20) oleyl ether;

about 25% polyoxyethylene (20) undecyl ether;

about 20% of a different polyoxyethylene alkoxylate;

about 2.5% triethanolamine;

about 2.5% d-limonene;

about 25% amine alkylaryl sulfonate; and about 5% 2-ethyl-1-hexanol.

3. The formulations of claim 1, wherein said polyoxyethylene alkoxylate is polyoxyethylene alkyl phosphonate.

4. The formulations of claim 2, wherein said polyoxyethylene alkoxylate is polyoxyethylene alkyl phosphonate.

* * * * *